US009677325B2

(12) United States Patent
Buermann et al.

(10) Patent No.: US 9,677,325 B2
(45) Date of Patent: Jun. 13, 2017

(54) BRACKET

(71) Applicant: Hyperkinetics Corporation, Williamstown, VT (US)

(72) Inventors: Henry Buermann, Brookfield, VT (US); Wade Holt, Williamstown, VT (US); Tony Ziter, Williamstown, VT (US)

( * ) Notice: Subject to any disclaimer, the term of this patent is extended or adjusted under 35 U.S.C. 154(b) by 0 days.

(21) Appl. No.: 14/768,214

(22) PCT Filed: Feb. 14, 2014

(86) PCT No.: PCT/US2014/016589
§ 371 (c)(1),
(2) Date: Aug. 14, 2015

(87) PCT Pub. No.: WO2014/127284
PCT Pub. Date: Aug. 21, 2014

(65) Prior Publication Data

US 2015/0376937 A1 Dec. 31, 2015

Related U.S. Application Data

(60) Provisional application No. 61/764,812, filed on Feb. 14, 2013.

(51) Int. Cl.
*E04G 3/00* (2006.01)
*E06B 7/26* (2006.01)
(Continued)

(52) U.S. Cl.
CPC ..... *E06B 7/26* (2013.01); *E04B 1/762* (2013.01); *E04F 10/02* (2013.01); *E06B 7/12* (2013.01)

(58) Field of Classification Search
CPC .... E06B 7/26; E06B 7/12; E04B 1/762; E04F 10/02
(Continued)

(56) References Cited

U.S. PATENT DOCUMENTS 2,542,919 A 2/1951 Freeman
4,881,707 A * 11/1989 Garfinkle ..... G09F 7/22 248/222.12
(Continued)

OTHER PUBLICATIONS

International Search Report from PCT Application No. PCT/US14/16589 dated Jun. 3, 2014.
(Continued)

*Primary Examiner* — Gwendolyn Baxter
(74) *Attorney, Agent, or Firm* — Waller Lansden Dortch & Davis, LLP; Blake M. Bernard

(57) ABSTRACT

The presently-disclosed subject matter includes a bracket that can be mounted to a surface, and that can protect openings and other water sensitive areas on the surface from water damage. Embodied brackets can comprise a mount that can be mounted to a surface, an extension that protrudes outwardly from the mount, and an attachment portion to which a water resistant material can be attached. In some embodiments the bracket is mounted to a wall above and/or near an opening or other water sensitive area, and the bracket and/or water sensitive material protect the opening or water sensitive area from water damage. In some implementations two or more brackets are attached to form a continuous bracket structure.

18 Claims, 8 Drawing Sheets

(51) Int. Cl.

| | |
|---|---|
| ***E04B 1/76*** | (2006.01) |
| ***E06B 7/12*** | (2006.01) |
| ***E04F 10/02*** | (2006.01) |

(58) Field of Classification Search
USPC ... 248/220.21, 279.1, 296.1, 292.11, 292.12, 248/292.14; 40/661.06
See application file for complete search history.

(56) References Cited

U.S. PATENT DOCUMENTS

| | | | | |
|---|---|---|---|---|
| 4,909,464 | A * | 3/1990 | Levine | G09F 7/22 16/284 |
| 6,216,889 | B1 | 4/2001 | Chang | |
| 6,571,498 | B1 * | 6/2003 | Cyrluk | G09F 3/204 108/27 |
| 7,490,803 | B1 | 2/2009 | Graves | |
| 7,648,111 | B2 | 1/2010 | Goldstein | |
| 8,231,093 | B2 * | 7/2012 | Tran | A47H 1/142 16/87.2 |
| 8,469,207 | B2 | 6/2013 | Rowan et al. | |
| 2006/0175025 | A1 | 8/2006 | McMenamin et al. | |
| 2007/0200040 | A1 | 8/2007 | McMenamin et al. | |

OTHER PUBLICATIONS

Written Opinion from PCT Application No. PCT/US14/16589 dated Jun. 3, 2014.
Extended European Search Report dated Oct. 7, 2016 in corresponding European Patent Application No. 14752164.5.

* cited by examiner

BRACKET

RELATED APPLICATIONS

This application is a §371 National Stage Application of International Patent Application No. PCT/US14/016589, filed Feb. 14, 2014, which claims priority from U.S. Provisional Patent Application No. 61/764,812, filed Feb. 14, 2013, the entire disclosure of which are incorporated herein by this reference.

TECHNICAL FIELD

The presently-disclosed subject matter relates to a bracket for securing a water resistant material to a surface. In particular, embodiments of the presently-disclosed subject matter relate to a bracket that can attach to a wall surface and secure a water resistant material over an opening and/or water sensitive area.

BACKGROUND

The outer walls of most modern buildings are insulated with an insulating material. In some buildings the exterior walls comprise two separate wall surfaces, and a layer of an insulating material is placed between the two surfaces. The insulating material can minimize the effects of ambient temperature fluctuations and generally reduce heating and cooling losses. One type of insulation is a spray foam insulation, such as a polyurethane spray foam insulation. Some types of spray foam insulations are known to expand, sometimes by many factors, and can produce heat and gases when curing into a final rigid state.

Although these buildings can be well insulated, rain water, water formed as a result of condensation, and the like can collect and drip down surfaces that have been insulated. To prevent the water that potentially collects and drips down a wall from causing damage, water resistant materials, such as flashing, are typically draped from a wall above any openings and/or other water sensitive areas. More particularly, one side of a water resistant material is secured to a portion of a wall and the opposing side is draped over the opening or water sensitive area. This ensures that any water that may drip down the side of a wall does not enter the opening or contact the water sensitive area, but instead is redirected over the water resistant material.

Current building techniques require that water resistant materials be applied to walls before spraying any foam insulation on to the walls. However, in order to fully insulate areas that immediately surround covered openings and other areas, the free end of the water resistant material is folded upwardly and is temporarily attached above the opening or area. This permits the spray foam insulation to reach the areas above the openings and water sensitive areas that would otherwise be covered by the water resistant material. Then, once the spray foam insulation has cured and hardened, the water resistant material is returned to its original position so that it covers and protects any openings and water sensitive areas.

This known technique poses several problems. Typically, the free end of the water resistant material is temporarily attached to a wall with a nail, staple, pin, or the like while the spray foam insulation is being applied. This forms holes in the water resistant material that increase the risk of water penetrating through the material. Spray foam insulation can also be deposited onto the water resistant material, possibly inadvertently. When the insulation cures and hardens, the heat, expansion forces, and other effects caused by the foaming insulation can deform the water resistant material. Deformed water resistant materials embedded in the insulation or external to it can direct the water flow in a manner inconsistent with the desired result, can be difficult to drape over openings and other water sensitive areas, and can be ineffective at repelling water. Deformed sections of water resistant materials that meet at a corner of a structure can also be relatively more difficult to properly lay over one another, and therefore additional material and/or modifications are necessary to ensure that no water leakage and damage will occur. Further still, the spray foam insulation on the structure can be damaged or break when the water resistant material is returned to its original position after the foam insulation has hardened, which can decrease the durability and effectiveness of the spray foam insulation.

Accordingly, there remains a need for a system and method that ensures that openings and other water sensitive areas on a surface remain free from water damage. A system and method that meets these needs and that can be quickly and easily implemented would be highly desirable and beneficial.

SUMMARY

The presently-disclosed subject matter meets some or all of the above-identified needs, as will become evident to those of ordinary skill in the art after a study of information provided in this document.

This Summary describes several embodiments of the presently-disclosed subject matter, and in many cases lists variations and permutations of these embodiments. This Summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this Summary or not. To avoid excessive repetition, this Summary does not list or suggest all possible combinations of such features.

The presently-disclosed subject matter includes a bracket for mounting to a surface. The bracket can comprise a mount that includes a mounting surface and an exterior surface, an extension including a first end that is coupled to, directly or indirectly, the exterior surface of the mount and a second end that is located opposite the first end, and an attachment portion that extends along a length of the second end of the extension. The mount can be for attaching the bracket to a surface. Furthermore, the attachment portion can be for securing a water resistant material to the bracket.

In some embodiments the attachment portion is configured to receive a rod, the rod being configured to secure the water resistant material to the bracket. For instance, the attachment portion can include a tubular member including a substantially semicircular cross section, wherein edges of the tubular member define an opening that extends along a longitudinal length of the tubular member. In some embodiments the rod further comprises a fin that extends a longitudinal direction of the rod, and the fin extends through an opening of the tubular member when the rod is received by the tubular member.

Exemplary attachment portions can further comprise a protrusion that extends from an interior side of one of the edges of the tubular member. In some embodiments the protrusion comprises a first face that is adjacent to the interior side of the tubular member that defines a first angle of about 90 degrees or less relative to the interior side of the tubular member, and can further comprise a second face adjacent to a side of the first face that is opposite the interior side of the tubular member that defines a second angle of about 90 or less degrees relative to the first face. In some embodiments the bracket comprises two protrusions, and each of the two protrusions extend from each of the two edges of the tubular member. The protrusions can facilitate the attachment of a rod and/or water resistant material to the bracket.

In some exemplary brackets, the mount comprises a flat plate. In some embodiments the mount of the bracket includes holes to bolt, screw, and/or nail the mount to a surface (e.g., a wall). In some embodiments of brackets, the second end of the extension is at least about 1 inch to about 6 inches from the mounting surface of the mount.

In some embodiments the extension of the bracket defines an angle of about 1 degree to about 179 degrees relative to a plane defined by the mounting surface of the mount, and in further embodiments the bracket defines an angle of about 1 degree to about 90 degrees relative to a plane defined by the mounting surface of the mount. In some embodiments this angle is about 15, about 30, about 45, about 60, about 75, about 90, about 105, about 120, about 135, about 150, or about 165 degrees. In other embodiments the attachment portion is located on a bottom end side of the extension.

In some embodiments the water resistant material is partially or completely impermeable to water. The water resistant material can be a membrane flashing material. The water resistant material can also be selected from a felt, a polymer film, a woven polymer material, a coated copper sheet, an uncoated copper sheet, a coated stainless steel sheet, an uncoated stainless steel sheet, combinations thereof, or the like.

Also disclosed herein are systems comprising a plurality of brackets, each bracket comprising a mount for attaching the bracket to a surface that includes a mounting surface and an exterior surface, an extension including a first end that is coupled to, directly or indirectly, the exterior surface of the mount and a second end that is located opposite the first end, and an attachment portion that includes a tubular member and extends along a length of the second end of the extension for securing a water resistant material to the bracket. Systems can also comprise a rod that can be received by the tubular members of the brackets.

Further still, in some embodiments the systems comprise brackets that further include attachment tabs that are provided at ends of the mount, the extension, the attachment portion, or a combination thereof of the brackets. The attachment tabs of a first bracket can be mated and aligned with the attachment tabs of a second bracket when connecting two or more brackets together into a bracket structure. Brackets can also comprise a pin receiving portion, and the systems can further comprise a pin dimensioned to be inserted into the pin receiving portions. Other embodiments of brackets comprise clips for attaching two or more brackets, and the clips can include a shape that conforms to a shape of the attachment portions of the brackets.

The presently-disclosed subject matter also includes methods for using a bracket to secure a water resistant material on a surface (e.g., a wall). In some embodiments the method comprises attaching the mount to a surface and securing a water resistant material to the attachment portion. In some embodiments, a method can further comprise applying insulation on the surface after the step of attaching the mount and before the step of securing the water resistant material.

Further features and advantages of the presently-disclosed subject matter will become evident to those of ordinary skill in the art after a study of the present application.

DESCRIPTION OF EXEMPLARY EMBODIMENTS

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

While the terms used herein are believed to be well understood by one of ordinary skill in the art, definitions are set forth to facilitate explanation of the presently-disclosed subject matter. Unless defined otherwise, all technical terms used herein have the same meaning as commonly understood by one of ordinary skill in the art to which the presently-disclosed subject matter belongs. Although any methods and devices similar or equivalent to those described herein can be used in the practice or testing of the presently-disclosed subject matter, representative methods and devices are now described.

Following long-standing patent law convention, the terms "a", "an", and "the" refer to "one or more" when used in this application, including the claims. Thus, for example, reference to "a protrusion" includes a plurality of such protrusions, and so forth.

Unless otherwise indicated, all numbers expressing quantities, dimensions, and so forth used in the specification and claims are to be understood as being modified in all instances by the term "about". Accordingly, unless indicated to the contrary, the numerical parameters set forth in this specification and claims are approximations that can vary depending upon the desired outcome sought to be obtained by the presently-disclosed subject matter.

The presently-disclosed subject matter includes a bracket for securing a water resistant material on a surface above and/or around openings, water sensitive areas, and the like that are to be protected from water. In some embodiments the bracket secures a water resistant material to a wall above an opening or a water sensitive area on a building. Among other things, the brackets can mitigate or prevent water, including water formed as a result of condensation, from dripping down a surface into an opening or onto a water sensitive area. Embodiments of brackets can also be used on surfaces that will be insulated with a spray foam insulation without unduly compromising the durability or effectiveness of the spray foam insulation.

As used herein, a top end side refers to a side that will generally face upwardly when a bracket is installed on a surface. Similarly, as used herein, a bottom end side of a component refers to a side that will generally face downwardly when the bracket is installed on a surface.

Figure 1:
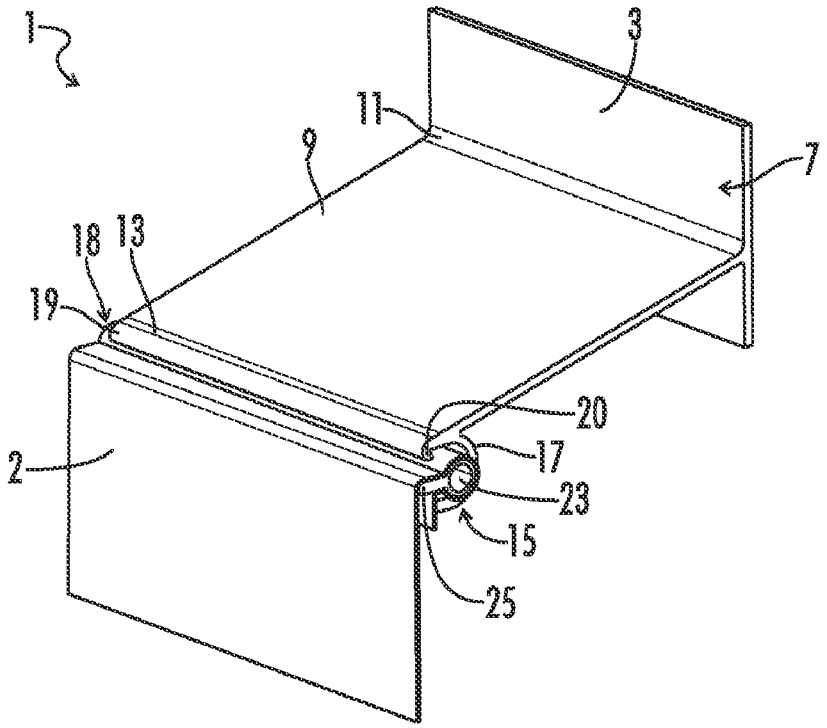
FIG. 1 is a perspective view of an embodiment of a bracket that is secured to a water resistant material.

Looking to now FIG. 1, an embodiment of the presently-disclosed subject matter is shown. FIG. 1 shows a perspective view of a bracket 1 that comprises a mount 3, an extension 9, and an attachment portion 15. The mount 3, extension 9, and attachment portion 15 all form one continuous object. In this regard, the bracket 1 can be formed by an extrusion process, and can comprise a polymer, plastic, metal, or the like. Some embodiments of brackets 1 are formed from two or more distinct objects. For example, at least two of the mount 3, extension 9, and attachment portion 15 can be distinct objects that are attached to one another to form the bracket 1.

The mount 3 comprises a mounting surface 5 and an exterior surface 7. When the bracket 1 is attached to a surface, the mounting surface 5 of the mount 3 can be adjacent to the surface (e.g., wall). The exterior surface 7 of the mount 3 can be opposite the mounting surface 5. In some embodiments the mount 3 is a substantially flat plate, wherein the mounting surface 5 and the exterior surface 7 correspond to opposite sides of the substantially flat plate.

A mount 3 can be used to attach the bracket 1 to a surface. For instance, a mount 3 can be taped, glued, bolted, screwed, nailed, or the like to a surface. In some embodiments the mount 3 can comprise an adhesive on the mounting surface 5 to attach the mount 3 to a surface. In some embodiments the mount 3 is provided with holes extending therethrough, and bolts, screws, nails, or the like can be inserted through the holes to attach the mount 3 to a surface. In some embodiments, including embodiments wherein the mount 3 does not comprise holes extending therethrough, self-tapping screws or nails or the like can be used to attach the mount 3 to a surface.

The dimensions of the bracket 1, including the mount 3, are not particularly limited and can be adjusted to meet the limitations of a particular situation. For example, the mount 3 can be dimensioned to provide a mounting surface 5 that is sufficient for attaching the bracket 1 to a surface. In specific embodiments the mount 3 has a length of about 5 feet to about 8 feet, a height of about 2.75 inches, and a thickness of about 0.125 inches. The mount 3 can have a length that corresponds to a length of the extension 9. The mount 3 can also have a length that corresponds with a length of a wall or structure. Furthermore, in some embodiments the mount 3 can be a continuous object, and in other embodiments a mount 3 can correspond to a plurality of distinct components that can attach a bracket 1 to a surface.

Figure 6:
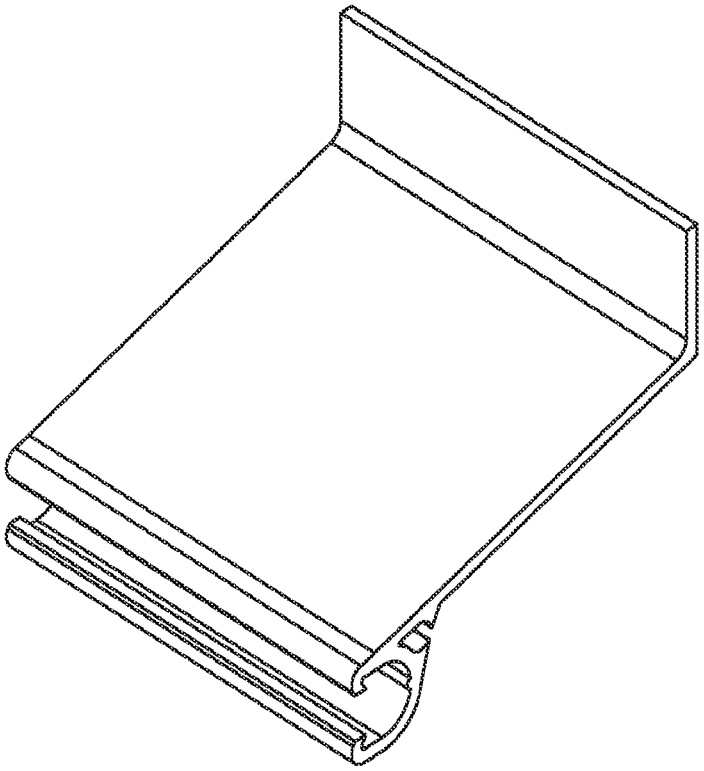
FIG. 6 is a perspective view of another embodiment of a bracket.

The mount 3 can extend above, below, or both above and below an extension 9. FIG. 1 shows a bracket 1 wherein the mount 3 extends both above and below the extension 9. FIG. 6 shows another exemplary bracket 1, wherein the mount 3 only extends above an extension 9. In some implementations, a bracket 1 including a mount 3 that only extends above an extension 9 can be mounted with the extension 9 being adjacent to an opening 18, a water sensitive area, or the like.

As mentioned above, the extension 9 can be coupled to, directly or indirectly, the exterior surface 7 of the mount 3. For instance, the extension 9 may directly couple to the mount 3, or it may be indirectly coupled via a mount, adapter, or the like. The extension 9 can comprise a first end 11, which is coupled to the exterior surface 7 of the mount 3, and a second end 13, which is located opposite the first end 11 with respect to a width of the extension 9. The first end 11 and the second end 13 of the extension 9 refer to end portions of the extension 9, but they are not necessarily blunt ends of an object. For example, certain embodiments of brackets 1 are one unitary extruded object, and therefore the first end 11 refers to an end portion of the extension 9 that molds into the mount 3, and the second end 13 refers to an end portion of the extension 9 that molds into the attachment portion 15.

The dimensions of the extension 9 are not particularly limited, and can depend on the type structure a bracket 1 is to be mounted to, the size of the openings and/or water sensitive areas to be covered, and so forth. In some embodiments the extension 9 has a width, corresponding to a distance between its first end 11 and its second end 13, of about 1 inch to about 6 inches. In some embodiments the extension 9 has a width of more than about 1 inch, more than about 2 inches, more than about 3 inches, more than about 4 inches, more than about 5 inches, or more than about 6 inches. In some embodiments the width of the extension 9 is configured so that a minimum distance between the second end 13 of the extension 9 and a plane defined by the mounting surface 5 of the mount 3 is sufficient to cover the opening and/or area to be located below the bracket 1. In some embodiments the width of the extension 9 is equal to or greater than the thickness of the insulating material that is applied thereto. In some embodiments the width of the extension 9 is less than the width of an inter-wall space (i.e., space between two external walls). In some embodiments a bracket 1 can direct water to vents on an exterior wall.

FIG. 1 also shows an attachment portion 15 that extends along a length of the second end 13 of the extension 9. The attachment portion 15 can be configured to secure to a water resistant material 2, thereby securing the water resistant material 2 to the bracket 1. Certain embodiments further comprise the ability to removably secure a water resistant material 2 to the attachment portion 15, which can be beneficial should there be a need to remove or replace the water resistant material 2 after it has been secured to an attachment portion 15.

The attachment portion 15 can receive a rod 23, and the rod 23 can be used to secure the water resistant material 2 to the attachment portion 15. More specifically, as shown in FIG. 1, the attachment portion 15 can include a tubular member 17 that has a substantially semicircular cross section. The term "semicircular" is used herein to refer to any shape and that is not fully enclosed. For example, when viewed as a cross section, the tubular member 17 can have a shape that is generally rectangular, triangular, circular, or a combination thereof. Furthermore, when viewed from a cross section, the edges 19 formed by the tubular member 17 can define an opening 18 that extends along a longitudinal length of the tubular member 17. FIG. 1 further shows that the rod 23 can further comprise a fin 25 that extends the longitudinal length of the rod 23, and the fin 25 can extend into the opening 18 when the rod 23 is received by the tubular member 17.

In some instances the bracket 1 is provided with a covering that covers an opening 18 of the tubular member 17. The covering can cover the opening 18 of the tubular member 17 when, for example, insulation is being applied to a wall that the bracket 1 is mounted to. Then, after the insulation has been applied, the covering can be removed, cut, or the like to permit installation of the rod 23 and water resistant material 2 on to the bracket 1. Thus, the covering can keep insulating material from entering the tubular member 17, which could make installation of the rod 23 and water resistant material 2 more difficult or impossible. In some embodiments the covering includes tape, and the tape is removed from the opening 18 of the tubular member 17 once an insulating material has been applied to a wall surface that the bracket 1 is mounted to.

Figure 2:
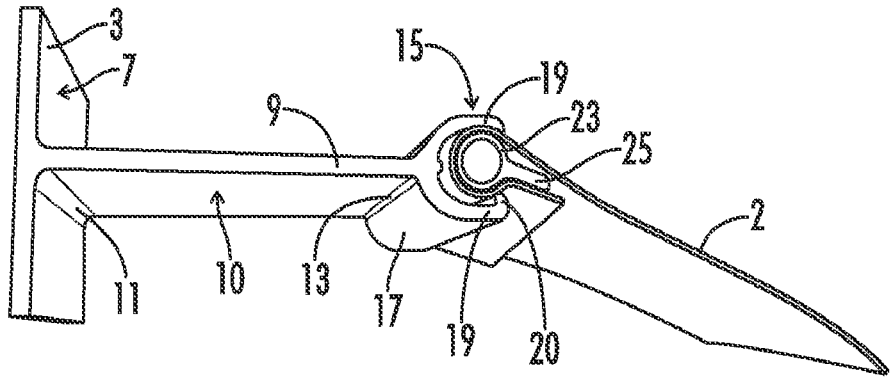
FIG. 2 is a side view of another embodiment of a bracket that is secured to a water resistant material.

Referring now to FIG. 2, a side view of another embodied bracket 1 is shown. The bracket 1 comprises an attachment portion 15 that extends along the second end 13 of the extension 9 and that is symmetrically aligned with respect to the top end side of the extension 9 and the bottom end side of the extension 9. The bracket 1 also comprises an extension 9 that defines an about 90 degree angle relative to a plane defined by the mounting surface 5 of the mount 3.

Figure 3:
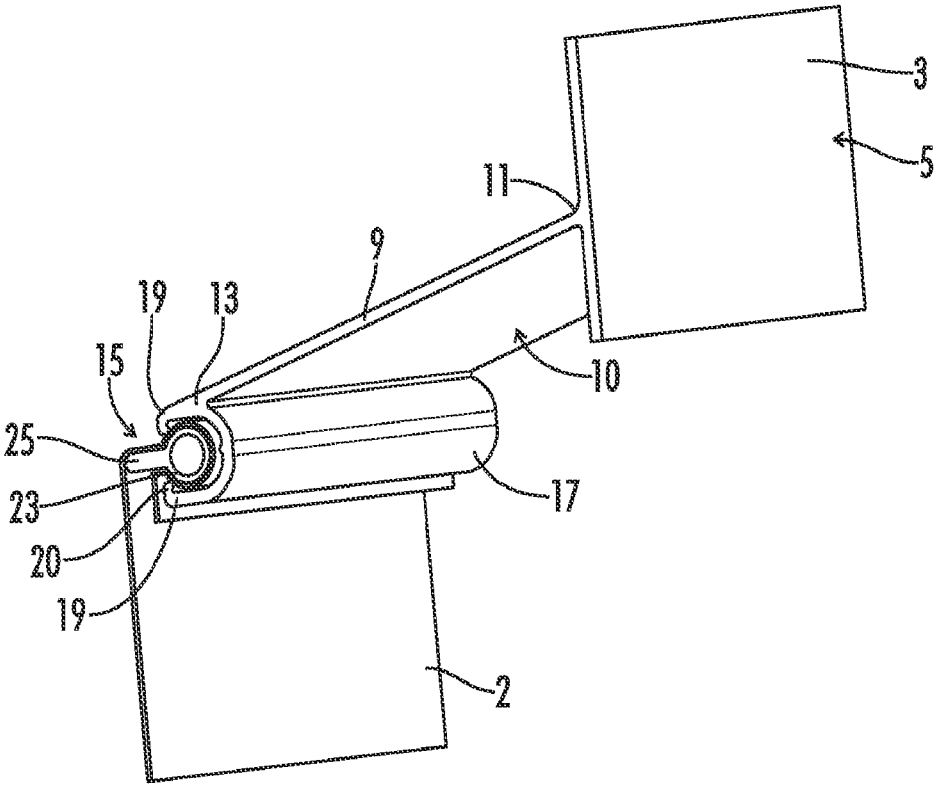
FIG. 3 is a rear view of yet another embodiment of a bracket that is secured to a water resistant material.
Figure 4:
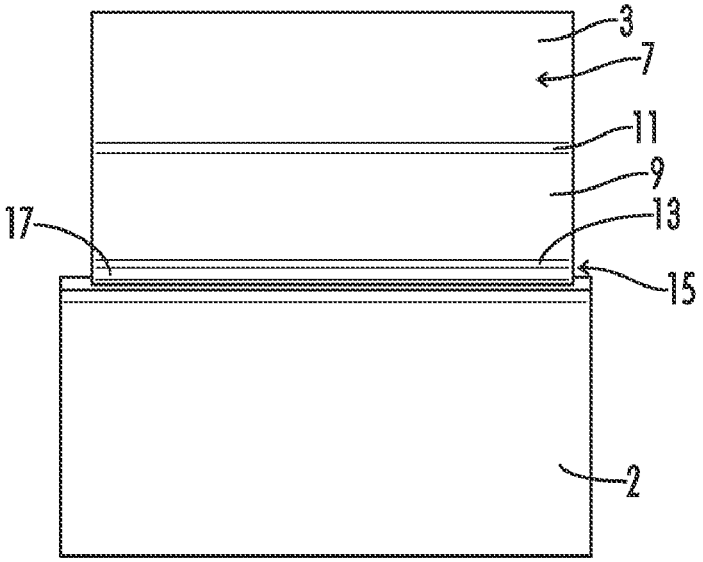
FIG. 4 is a front view of the bracket of FIG. 3 that is secured to a water resistant material.
Figure 5:
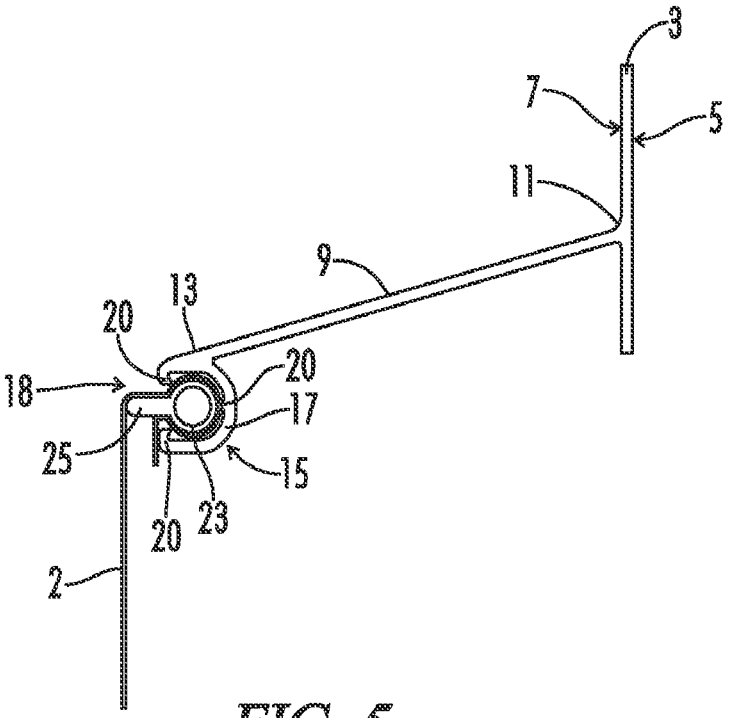
FIG. 5 is a side view of the bracket of FIG. 3 that is secured to a water resistant material.

In this regard, FIGS. 3 to 5 show yet another embodiment of a bracket 1 from, respectively, a rear view, a front view, and a side view. The extension 9 can define an angle of 1 to 179 degrees relative to a plane defined by the mounting surface 5 of the mount 3. An angle defined by the extension 9 and the mounting surface 5 is not particularly limited, and in some embodiments can be about 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, or 175 degrees when measured from the bottom end side of the extension 9.

The particular embodiment of a bracket 1 shown in FIG. 2 includes an extension 9 that defines a 90 degree angle relative to the mounting surface 5. In certain applications it can be desirable to have an angle defined by the mounting surface 5 and the extension 9 to be less than about 90 degrees (e.g., 75 degrees) such that, when the bracket 1 is mounted, the first end 11 of the extension 9 is higher than the second end 13 of the extension 9. By virtue of this configuration, water that collects on the extension 9 can drain across the extension 9 toward its second end 13, and can eventually move onto the water resistant material 2. The angle defined by the extension 9 and the mounting surface 5 can be adjusted so as to achieve this effect when a bracket 1 is attached to a surface that is not vertical.

The embodiment shown in FIGS. 3 to 5 also comprises an attachment portion 15 that is located on a bottom end side 10 of the extension 9. In certain circumstances, this configuration permits water to flow across the extension 9 and over its second end 13 without being hindered by the attachment portion 15. Placing the attachment portion 15 on a bottom end side 10 of the bracket 1 can therefore prevent water from accumulating on the extension 9, and particularly towards its second end side 13. The location of the attachment portion 15, however, is not particularly limited, and the attachment portion 15 can be located only partially below a bottom end side 10 of an extension 9 (e.g., FIG. 2) or completely above a bottom end side 10 of an extension 9, for example.

Now referring to FIGS. 1 to 5 collectively, the embodied brackets 1 are secured to a water resistant material 2. To secure the water resistant material 2 to the attachment portion 15, a portion of the water resistant material 2 is placed between an interior side of the tubular member 17 and an exterior side of the rod 23. The water resistant material 2 can be secured by the tubular member 17 and the rod 23 exerting a force (e.g., frictional force) on the water resistant material 2. Consequently, in certain embodiments movement of the rod 23, the water resistant material 2, and the tubular member 17 relative to one another can be limited or prevented to further ensure that the water resistant material 2 remains secured to the attachment portion 15.

Figure 7:
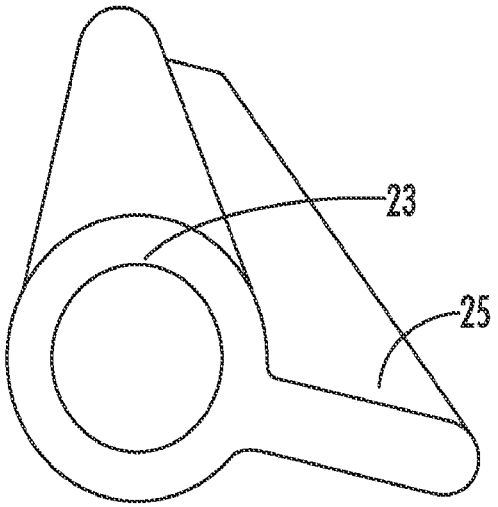
FIG. 7 is a perspective view of a rod to be used in conjunction with an embodiment a bracket.

Looking now to FIG. 7, there is shown a rod 23 that comprises a fin 25 that extends in the longitudinal direction of the rod 23. When the rod 23 is received by the tubular member 17, the fin 25 can extend into the opening 18 of the tubular member 17. As a result of the fin 25 extending into the opening 18, the rod 23 cannot rotate freely within the tubular member 17 when the water resistant material 2 is secured to the attachment portion 15, but instead the rod 23 is limited by the range of motion that the fin 25 has within the opening 18 of the tubular member 17. In different embodiments the fin 25 can extend partially, completely, or beyond the opening 18 of the tubular member 17. In some instances the fin 25 is angled such that it generally diverts any water away from a surface that the bracket 1 is mounted to.

Figure 8:
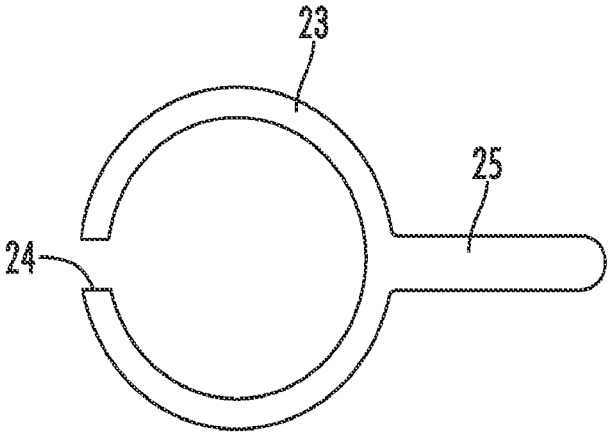
FIG. 8 is a side view of a rod to be used in conjunction with an embodiment a bracket.

As shown in FIG. 8, some embodiments of rods 23 further include a gap 24 extending along their longitudinal length. In some instances, a rod 23 with a gap 24 along its length can compress upon being installed in a tubular member 17, thereby permitting the tubular member 17 to receive the rod 23 or the rod 23 and the water resistant material 2. Alternatively or additionally, the tubular member 17 can be configured to expand to receive the rod 23 or the rod 23 and the water resistant material 2. In some embodiments a compressible rod 23 and/or an expandable tubular member 17 favor their original non-compressed or non-expanded shape, such that when a water resistant material 2 is installed in the bracket 1 it is frictionally held between the rod 23 and the tubular member 17.

Some embodiments further comprise one or more protrusions 20 that extend from an interior side of the tubular member 17. The protrusions 20 can be located at any point on the interior side of the tubular member 17, including at its edges 19 or any location therebetween. A protrusion 20 can extend from the interior side of one or both of the edges 19 of a tubular member 17. In some embodiments, the protrusions 20 can minimize the amount a rod 23 and/or water resistant material 2 will move relative to an attachment portion 15. Protrusions 20 can also help retain a rod 23 and/or a water resistant material 2 within a tubular member 17. Still further, some embodiments of protrusions 20 reduce the effective interior diameter of the tubular member 17, thereby permitting the rod 23 and/or water resistant material 2 to be retained more tightly within the tubular member 17.

Figure 9:
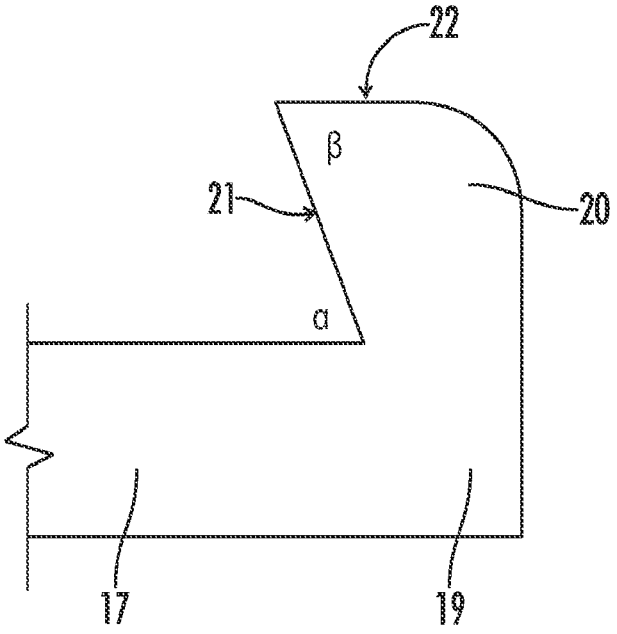
FIG. 9 is an enlarged cross-sectional view of an embodiment of a protrusion located on an interior side of a tubular member.

FIG. 9 shows an embodied protrusions 20 that is angled to increase its ability to meet the above-described functions.

FIG. 9 shows an enlarged cross sectional view of the protrusion 20 that extends from the interior side of one of the edges 19 of a tubular member 17. The protrusion 20 comprises a first face 21 as well as a second face 22 that converges with the first face 21. The first face 21 can define a first angle α relative to the interior side of the tubular member 17, and the first face 21 can define a second angle β0 relative to the second face 22. In some embodiments the sum of the first angle α and the second angle β is about 180 degrees or less, and the sum can be about 30, 60, 90, 120, 150, or 180 degrees. By virtue of this configuration, the first face 21 and the second face 22 can converge to form a point on the protrusion 20 that is bias toward the interior side of the tubular member 17, and that can retain the rod 23 and/or water resistant material 2 in the tubular member 17.

It will be appreciated that protrusions 20 can extend from any point of an attachment portion 15 and can be varied in shape and size. For example, protrusions 20 may comprise distinct teeth, a continuous ridge that extends the longitudinal length of the tubular member 17, or the like. Furthermore, some embodiments of brackets 1 do not comprise protrusions 20. The opening 18 of a tubular member 17, with or without protrusions 20, can comprise a width that is less than a diameter of a rod 23 and/or a rod 23 including a water resistant material 2 wrapped on its exterior surface. In some embodiments, the rod 23 and water resistant material 2 cannot be removed through the opening 18 of the tubular member 17 unless the tubular member 17 is flexed to increase the width of the opening 18.

Figure 10:
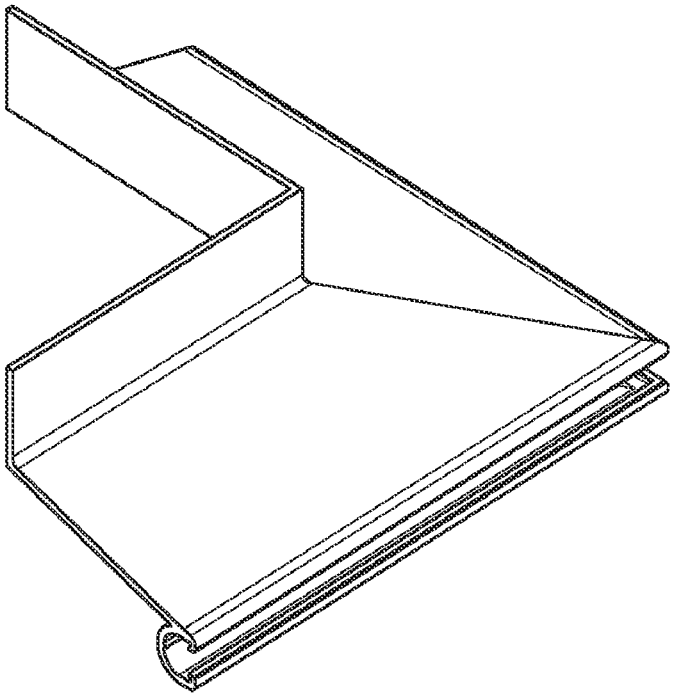
FIG. 10 is a perspective view of another embodiment of a bracket configured for attachment to an outside corner.
Figure 11:
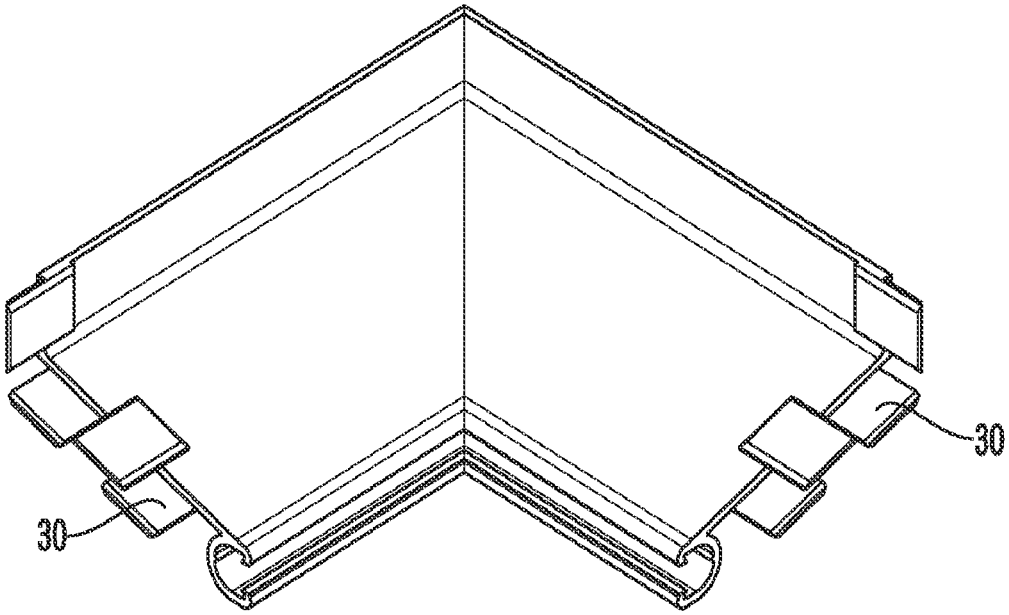
FIG. 11 is a perspective view of another embodiment of a bracket configured for attachment to an inside corner.

The presently-disclosed subject matter also includes brackets that are configured to be mounted at corners formed by two adjacent surfaces. In some embodiments the brackets are configured to be mounted to outside corners (i.e., corners of more than about 180 degrees). For example, FIG. 10 shows an exemplary bracket 1 for mounting on an about 270 degree outside corner. In some embodiments the brackets are configured to be mounted to inside corners (i.e., corners of less than about 180 degrees). For example, FIG. 11 shows an exemplary bracket 1 for mounting on an about 90 degree inside corner.

The presently-disclosed subject matter also includes systems or kits that include two or more of the present brackets that can be mounted adjacent to one another to form a continuous bracket structure. In some instances two or more brackets can be attached together to facilitate installation of the brackets at corners or other features on a surface as well as to permit the brackets to cover a larger area. In some instances the brackets are attached to one another so that one or more continuous brackets extends across a surface. In some instances a bracket will be attached to other brackets such that they wrap around an entire floor of a building.

Various means are available for attaching two or more brackets together to form one continuous bracket structure. In some instances two brackets will be attached to a surface adjacent to one another so that they form a continuous bracket structure. Optionally, a rod or similar structure can be inserted into at least a portion of the tubular members of each bracket such that the rod or similar structure substantially maintains the brackets' alignment with respect to one another.

Alternatively or additionally, brackets may be provided with attachment tabs that can align two adjacent brackets with respect to one another. FIG. 11 shows an exemplary bracket including attachment tabs 30 for attaching two or more brackets together. The attachment tabs 30 are provided at one or both ends of a bracket 1 and can help align and/or attach the two brackets into one continuous bracket. To attach two brackets including attachment tabs, the respective attachment tabs can be mated together to align and hold together the brackets. As shown in FIG. 11, the attachment tabs 30 can be provided on one or more portions of the bracket, including on the mount, the extension, and the attachment portion, or combinations thereof.

Figure 12:
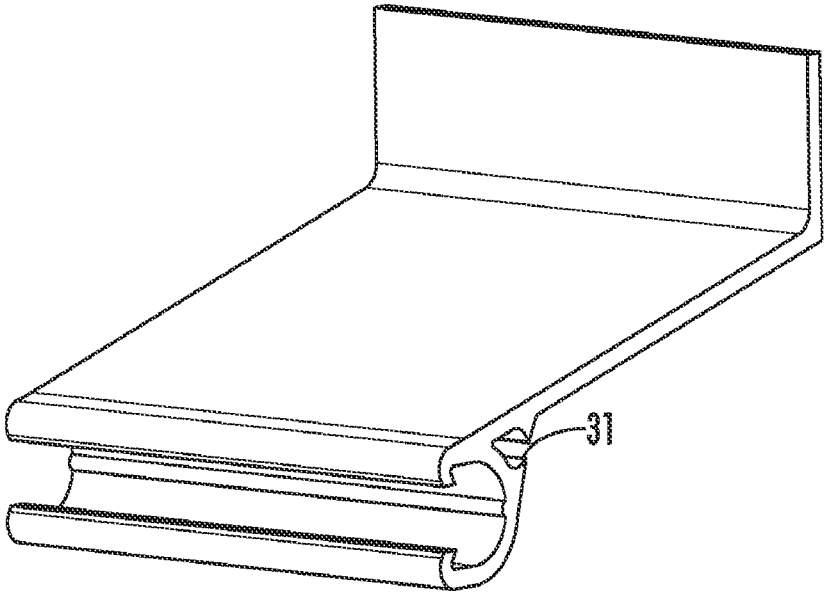
FIG. 12 is a perspective view of an embodiment of a bracket that includes a pin receiving portion.
Figure 13:
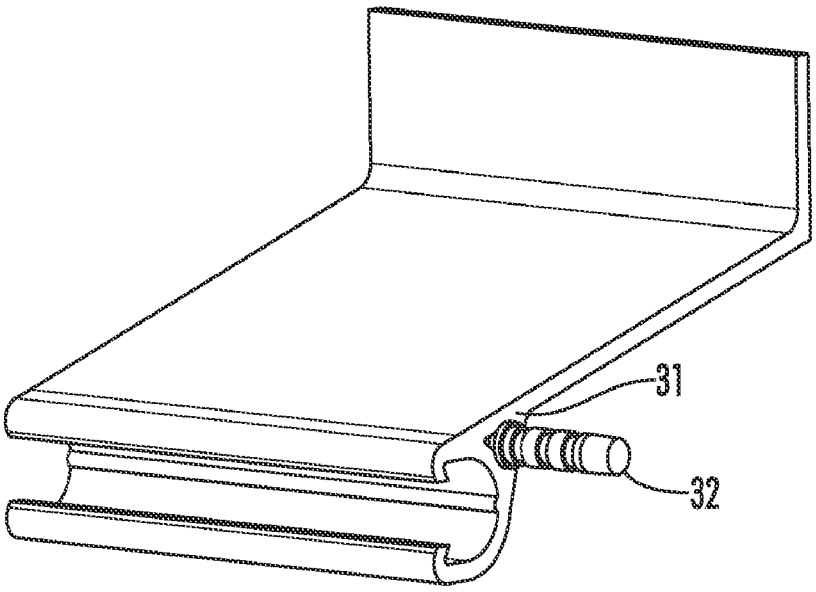
FIG. 13 is a perspective view of the bracket of FIG. 12 that includes a pin in the pin receiving portion.

FIGS. 12 and 13 show another embodiment of the brackets that can be attached together. The brackets 1 are provided with a pin receiving portion 31. The pin receiving portion in FIG. 12 is a generally semicircular portion that extends adjacent to the tubular member 17 along a bottom end side 10 of the extension 9. A pin 32 can be inserted into the pin receiving portion 31 of a first bracket, and then a second bracket can be attached to the first bracket by extending the same pin 32 into a pin receiving portion 31 of the second bracket. The resulting bracket structure will comprise the first bracket and the second bracket that are adjacent and aligned with respect to one another, wherein the pin 32 extends into pin receiving portions 31 of both brackets. The pin receiving portion can be provided at various locations on a bracket, and can be provided at a location that does not interfere with the attachment portion.

Figure 14:
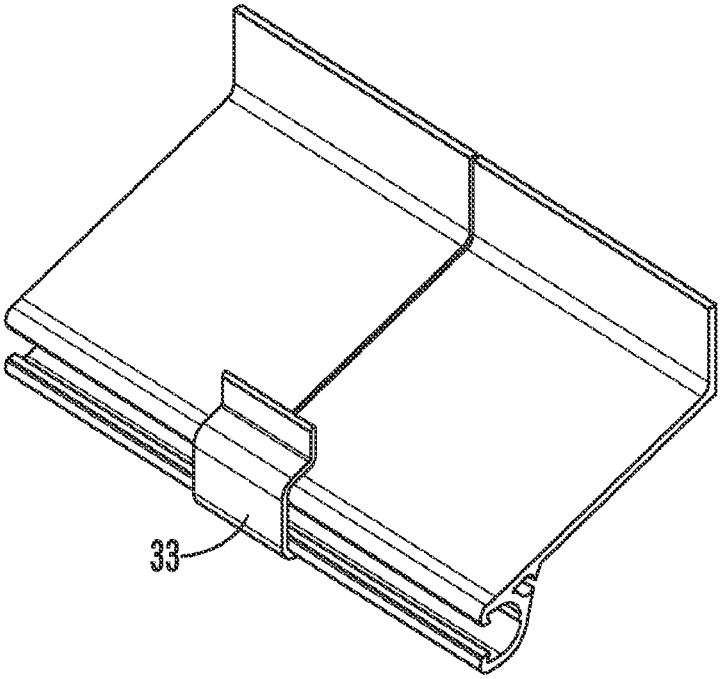
FIG. 14 is a perspective view of two brackets that are attached by a clip.
Figure 15:
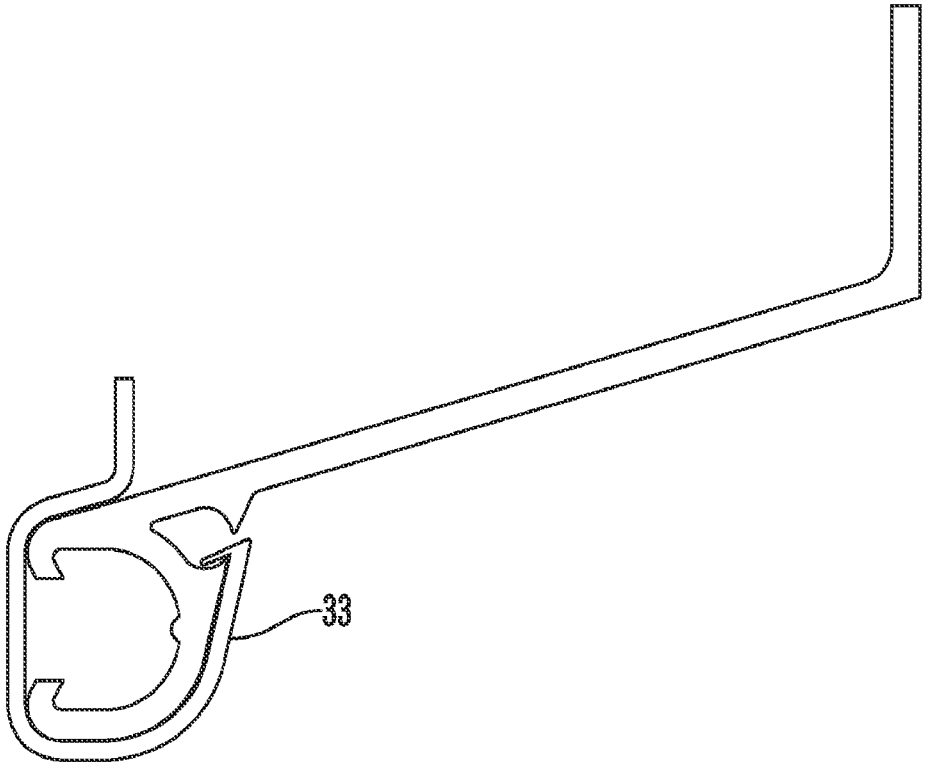
FIG. 15 is a cross sectional view of a clip attached to an embodiment of a bracket.

Further still, FIGS. 14 and 15 show yet another embodiment of the present brackets that can be attached together with a clip 33. The clip 33 is configured to span across two brackets and attach the two brackets so that they form a continuous bracket structure. FIG. 15 shows a cross sectional view of a clip 33 that is installed on a bracket 1. The clip 33 is shaped so as to substantially conform and attach to the attachment portion 15 of the bracket 1. Those of ordinary skill will appreciate other devices and methods for attaching two or more brackets together to form a continuous bracket structure.

The presently-disclosed subject matter further includes methods for utilizing a bracket. In some embodiments a method is performed using a bracket that includes a mount including a mounting surface and an exterior surface, an extension including a first end that is coupled, directly or indirectly, to the exterior surface of the mount and a second end that is located opposite the first end, and an attachment portion extending along a length of the second end of the extension. The method can comprise attaching the mount 3 of the bracket 1 to a surface, and then securing a water resistant material 2 to the attachment portion 15 of the bracket 1. In this regard, and as discussed above, the mount 3 can be attached to a surface, such as a wall, by any suitable means.

Likewise, the water resistant material 2 can be secured to the attachment portion 15 by any means known in the art. For some embodiments including an attachment portion 15 that includes a tubular member 17 with an opening 18 that extends along a longitudinal length thereof, the step of securing the water resistant material 2 to the attachment portion 15 can comprise placing the water resistant material 2 within an interior side of the tubular member 17, and then inserting a rod 23 into the tubular member 17 such that the water resistant material 2 is frictionally secured between the interior side of the tubular member 17 and an exterior surface of the rod 23. Using a similar embodiment of a bracket 1, another method comprises inserting the rod 23 and the water resistant material 2 into the tubular member 17 simultaneously with the water resistant material 2 wrapped around the rod 23. The water resistant material 2 can be adjusted to extend from the opening 18 of the tubular member 17.

The embodied bracket 1 and methods for using the same can be useful in applications where a spray foam insulation is to be applied to a surface. In such instances, the method can comprise attaching the mount 3 of the bracket 1 to the surface, and then applying the insulation on a surface. The method can further comprise applying the insulation before the step of securing the water resistant material 2 to the attachment portion 15 of the bracket 1. Thus, because the water resistant material 2 is not secured to the bracket 1 when the spray foam insulation is applied, the risk of deforming or damaging the water resistant materials 2 and/or the spray foam insulation is largely, if not completely, eliminated. Furthermore, in some embodiments the water resistant material 2 can be removably secured to the attachment portion 15 so that it may be removed and re-secured in order to apply more insulation, modify the water resistant material 2, or the like.

Once the water resistant material 2 has been secured to an attachment portion 15, the water resistant material 2 can be draped over any openings or water sensitive areas that should be protected from water. Water can come from the condensation of atmospheric air, rain, or from other sources may collect and drip down a surface. A bracket 1 attached to a surface can redirect the water over the top end side of the extension 9 and/or the water resistant material 2 so that it does not contact the covered openings and other water sensitive areas.

Furthermore, in some embodied methods, the fin 25 of a rod 23 can be used as a handle to install and/or remove the rod 23 from the tubular member 17. Furthermore, in some embodiments the rod 23 is removed from the tubular member 17 after a spray foam insulation is applied. For example, in some embodiments the rod 23 is installed in a tubular member 17 while applying a spray foam insulation, and then the rod 23 is removed and is reinstalled with the water resistant material 2. Notably, removing the rod 23 from the tubular member 17 after a spray foam insulation has been applied can break off any pieces of spray foam insulation that have cured on or within the tubular member 17. Thus, the act of removing and reinstalling the rod 23 can clean and remove pieces of spray foam insulation that may otherwise compromise the ability for the bracket 1 and/or water resistant material 2 to block water from entering any openings or other water sensitive areas.

The presently-disclosed subject matter still further includes methods for manufacturing a bracket. In some embodiments a bracket can be manufactured via an extrusion process. Of course, those of ordinary skill will appreciate other methods that can be used to manufacture embodiments of the presently-disclosed brackets.

It will be understood that various details of the presently disclosed subject matter can be changed without departing from the scope of the subject matter disclosed herein. For example, the dimensions and materials disclosed herein can be varied to meet the needs of particular circumstances. Furthermore, the attachment portion of the bracket can be varied without departing from the scope of the presently-disclosed subject matter so long as it permits a water resistant material to be secured to the bracket. For instance, in some embodiments the water resistant material may be glued, clamped, taped, pinned, or otherwise secured an attachment portion of a bracket. Furthermore, the foregoing description is for the purpose of illustration only, and not for imposing limitations regarding the presently-disclosed brackets or methods for utilizing and making the same.

LIST OF NUMBERED ELEMENTS

1—bracket
2—water resistant material
3—mount
5—mounting surface of mount
7—exterior surface of mount
9—extension
10—bottom end side of extension
11—first end of extension
13—second end of extension
15—attachment portion
17—tubular member
18—opening
19—edges
20—protrusion
21—first face of protrusion
22—second face of protrusion
23—rod
24—gap
25—fin
30—attachment tab
31—pin receiving portion
32—pin
33—clip

What is claimed is:

1. A bracket for mounting to a surface, comprising:
a mount for attaching the bracket to the surface that includes a mounting surface and an exterior surface;
an extension including a first end that is coupled, directly or indirectly, to the exterior surface of the mount and a second end that is located opposite the first end;
a tubular member extending along a length of the second end of the extension that includes a substantially semi-circular cross section; and
an opening extending along a longitudinal length of the tubular member,
wherein a water resistant material is configured to extend from the opening and be frictionally secured between an interior side of the tubular member and an exterior side of a rod that is received within the tubular member.

2. The bracket of claim 1, further comprising a protrusion that extends from the interior side of the tubular member.

3. The bracket of claim 2, wherein the protrusion is adjacent to the opening and further comprises:
a first face adjacent to the interior side of the tubular member that defines a first angle of about 90 degrees or less relative to the interior side of the tubular member, and
an second face adjacent to a side of the first face that is opposite the interior side of the tubular member that defines a second angle of about 90 or less degrees relative to the first face.

4. The bracket of claim 1, wherein the rod further comprises a fin that extends along a longitudinal direction of the rod, and wherein the fin extends through the opening of the tubular member when the rod is received within the tubular member.

5. The bracket of claim 1, wherein the extension defines an angle of about 1 degree to about 179 degrees relative to a plane defined by the mounting surface of the mount.

6. The bracket of claim 5, wherein the extension defines an angle of about 1 degree to about 90 degrees relative to a plane defined by the mounting surface of the mount.

7. The bracket of claim 1, wherein the tubular member is located on a bottom end side of the extension.

8. The bracket of claim 1, wherein the water resistant material is partially or completely impermeable to water.

9. The bracket of claim 1, wherein the water resistant material is a membrane flashing material.

10. The bracket of claim 1, wherein the water resistant material is selected from a membrane flashing material, felt, a polymer film, a woven polymer material, a coated copper sheet, an uncoated copper sheet, a coated stainless steel sheet, and an uncoated stainless steel sheet.

11. A system, comprising:

a plurality of brackets, each bracket including:

a mount for attaching the bracket to a surface that includes a mounting surface and an exterior surface;

an extension including a first end that is coupled, directly or indirectly, to the exterior surface of the mount and a second end that is located opposite the first end;

a tubular member and extending along a length of the second end of the extension that includes a substantially semicircular cross section; and an opening extending along a longitudinal length of the tubular member; and a rod configured to be received within the tubular members of the plurality of brackets, wherein a water resistant material is configured to extend from the openings of the plurality of brackets and be frictionally secured between an interior side of the tubular members and an exterior side of the rod received within the tubular members.

12. The system of claim 11, wherein the plurality of brackets further comprise attachment tabs provided at ends of the plurality of brackets, and wherein the attachment tabs on adjacent brackets are configured to mate with one another to align the adjacent brackets.

13. The system of claim 11, wherein the plurality of brackets further comprise a pin receiving portion provided at ends of the brackets, and wherein the pin receiving portions on adjacent brackets are configured to receive opposing ends of a pin to align the adjacent brackets.

14. The system of claim 13, wherein the system further comprises a pin dimensioned to be inserted into the pin receiving portions.

15. The system of claim 11, wherein the system further comprises a clip configured to attach to adjacent brackets to couple the adjacent brackets in alignment with one another.

16. The system of claim 15, wherein the clip includes an interior side having a shape that conforms to a shape of the tubular members of the plurality of brackets, and wherein the clip is configured to attach to the brackets by receiving the tubular members within the interior side of the clip.

17. A method for using a bracket to secure a water resistant material on a surface, the bracket including a mount including a mounting surface and an exterior surface, an extension including a first end that is coupled, directly or indirectly, to the exterior surface of the mount and a second end that is located opposite the first end, and a tubular member that extends along a length of the second end of the extension, comprising:

attaching the mount to a surface;

placing a portion of a water resistant material within an interior side of the tubular member; and receiving a rod within the tubular member to frictionally secure the water resistant material between the interior side of the tubular member and an exterior side of the rod.

18. The method of claim 17, further comprising applying insulation on the surface after the step of attaching the mount and before the step of placing the portion of the water resistant material within the interior side of the tubular member.

* * * * *